United States Patent [19]

Lemon et al.

[11] 4,118,958

[45] Oct. 10, 1978

[54] WASHING MACHINES AND RINSING MACHINES

[75] Inventors: Maurice Charles Lemon, Leigh; John Francis Spear, Holmbury St. Mary, both of England

[73] Assignee: Universal Towel Company, Sussex, England

[21] Appl. No.: 865,442

[22] Filed: Dec. 29, 1977

Related U.S. Application Data

[62] Division of Ser. No. 677,436, Apr. 15, 1976, Pat. No. 4,083,206.

[30] Foreign Application Priority Data

Apr. 17, 1975 [GB] United Kingdom ..... 15898/75

[51] Int. Cl.[2] ..... D06B 1/04

[52] U.S. Cl. ..... 68/22 R; 68/47; 68/62; 68/205 R

[58] Field of Search ..... 68/22 R, 43, 44, 45, 68/46, 47, 62, 205 R; 134/60, 72, 73; 15/40

[56] References Cited

U.S. PATENT DOCUMENTS

| | | | |
|---|---|---|---|
| 922,900 | 5/1909 | Hofmann | 68/43 X |
| 2,294,141 | 8/1942 | Trimble | 68/22 R |
| 2,886,403 | 5/1959 | Sellers | 68/62 X |
| 3,720,080 | 3/1973 | Grantham | 68/44 X |
| 3,762,869 | 10/1973 | Kennedy et al. | 68/22 R X |

FOREIGN PATENT DOCUMENTS

| | | | |
|---|---|---|---|
| 970,621 | 9/1964 | United Kingdom | 68/43 |

*Primary Examiner*—Philip R. Coe
*Attorney, Agent, or Firm*—Buell, Blenko & Ziesenheim

[57] ABSTRACT

A rinsing machine suitable for rinsing a washable dust mat is provided with first squeeze means, pressure means downstream of the first squeeze means and at least one intermediate squeeze means between the first squeeze means and the pressure means. Rinsing water is applied onto the mat between the pressure means and the last intermediate squeeze means, part of the rinsing water being allowed to pass upstream of each intermediate squeeze means in turn whereby the mat is rinsed at least twice from the single supply of rinsing water. The means which allow part of the rinsing water to pass upstream of each intermediate squeeze means is disposed within the length of the respective intermediate squeeze means. A washing machine comprises the rinsing machine and discharge means upstream of the first squeeze means for flushing a mat with a washing liquid.

9 Claims, 7 Drawing Figures

WASHING MACHINES AND RINSING MACHINES

This application is a divisional of our copending application Ser. No. 677,436 filed Apr. 15, 1976 and now U.S. Pat. No. 4,083,206.

BACKGROUND OF THE INVENTION

Field of the Invention

This invention relates to washing machines and rinsing machines. More particularly but not exclusively, the invention relates to machines for washing or at least rinsing dust mats made of cotton or nylon with a rubber or latex backing. Such mats are frequently coated with a film of fish oil, for example an oil sold under the trade name Impol, which during use of the mat becomes saturated with dirt and must be removed when the mat is washed.

SUMMARY

According to the invention a rinsing machine suitable for rinsing a washable dust mat comprises first squeeze means, pressure means downstream of the first squeeze means and at least one intermediate squeeze means between the first squeeze means and the pressure means, each successive squeeze means and pressure means extending transversely of the direction of movement of the mat and being spaced apart from each other longitudinally of the direction of movement of the mat, means for applying rinsing water onto the mat between the pressure means and the or the last intermediate squeeze means, and means for feeding the mat in a flat condition through the first squeeze means, intermediate squeeze means and pressure means in succession, there being provided means for passing or allowing part of the rinsing water to pass upstream of the or each intermediate squeeze means in turn whereby the mat is rinsed within each space by water of which a part is removed by the next downstream squeeze means and finally the pressure means, which means for passing or allowing part of the rinsing water to pass upstream of the or each intermediate squeeze means is disposed within the length of the respective intermediate squeeze means. It will be appreciated that the mat is rinsed at least twice from the single supply of rinsing water which is applied between the pressure means and the or the last intermediate squeeze means.

In one embodiment of the invention each of the first squeeze means, the or each intermediate squeeze means and the pressure means is a first roller cooperating with another roller between which each mat is fed in turn on a belt driven by the drive to the squeeze means and the pressure means.

Preferably the belt is a continuous belt and means are provided for counteracting any tendency for the mat to move laterally of its path, said counteracting means comprising a roller extending transversely of the belt and in contact therewith, reciprocating means for moving each end of the roller relatively to the other end in a direction longitudinally of the direction of movement of the belt, and sensing means for determining lateral movement of the belt, which sensing means causes the roller to be moved by the reciprocating means in the direction which will counteract the lateral movement of the belt. In practice the roller will hunt about a central vertical axis causing the belt to move laterally back and forth within the limits of the sensing means.

It is also preferred that the path of the mat determined by the successive squeeze and pressure means is straight and inclined upwardly to the horizontal in a downstream direction, e.g. inclined at an angle of 15° or less. Thereby a pool of rinsing water is formed on the mat downstream of the or each intermediate squeeze means and the first squeeze means.

The belt may be driven indirectly by a chain drive which drives each said other roller.

In another embodiment of the invention the path of the mat is arcuate. Preferably each of the first squeeze means, the or each intermediate squeeze means and the pressure means is a roller cooperating with central guide means of arcuate shape to squeeze each mat in turn passed therebetween.

It is preferred that the central guide means is a drum around at least a part of whose circumference the mat is passed during the rinsing operation, means being provided to drive the drum.

Preferably the means for passing or allowing part of the rinsing water to pass upstream of the or each intermediate squeeze roller comprises peripheral grooves in the roller. In the case of there being said grooves in two adjacent rollers, the grooves of each roller are preferably displaced longitudinally of the roller relatively to the grooves of the other roller.

Means are preferably provided for at least resisting part of the rinsing water from flowing laterally outwardly of each next upstream squeeze means.

It is also preferred that means are provided for urging the mat to retain its flat condition on the belt or other guide means as it passes towards the next downstream squeeze means or pressure means.

The invention also provides a washing machine suitable for washing a washable dust mat comprising a rinsing machine as described above, in combination with discharge means upstream of the first squeeze means for flushing a mat with a washing liquid part of which is removed from the mat by the first squeeze means.

Preferably the rinsing water removed from the mat by the intermediate squeeze means and the pressure means is collected in a tank from which is supplied the liquid for washing the next mat, the liquid preferably being steam heated and preferably mixed with a fresh quantity of detergent before it is applied to the mat.

It is also preferred that the washing liquid is collected after use and returned into the same tank from which it has been drawn, a proportion of the liquid and the effluent being allowed to pass out of the tank into a drain. The remainder of the washing liquid mixes with the collected rinsing water in the tank and comprises the supply for washing the next mat. Such a circulation system is very advantageous with regard to the saving of water and the amount of heat required to heat the water for washing each mat.

DESCRIPTION OF THE PREFERRED EMBODIMENTS

Referring to FIGS. 1 to 5, a washing machine for washable dust mats formed of cotton or nylon with a rubber or latex backing, comprises a top frame 10 and a bottom frame 11.

Figure 1:
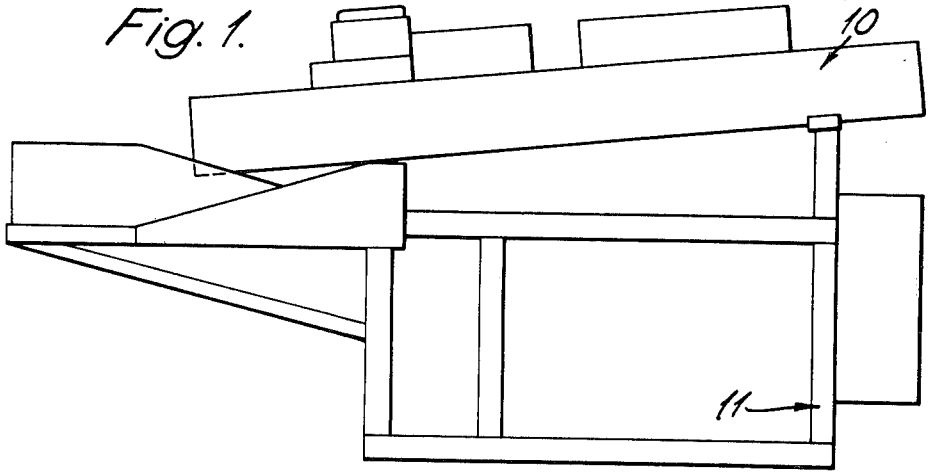
FIG. 1 is a side elevation, by way of example, of a washing machine for washable dust mats.
Figure 3:
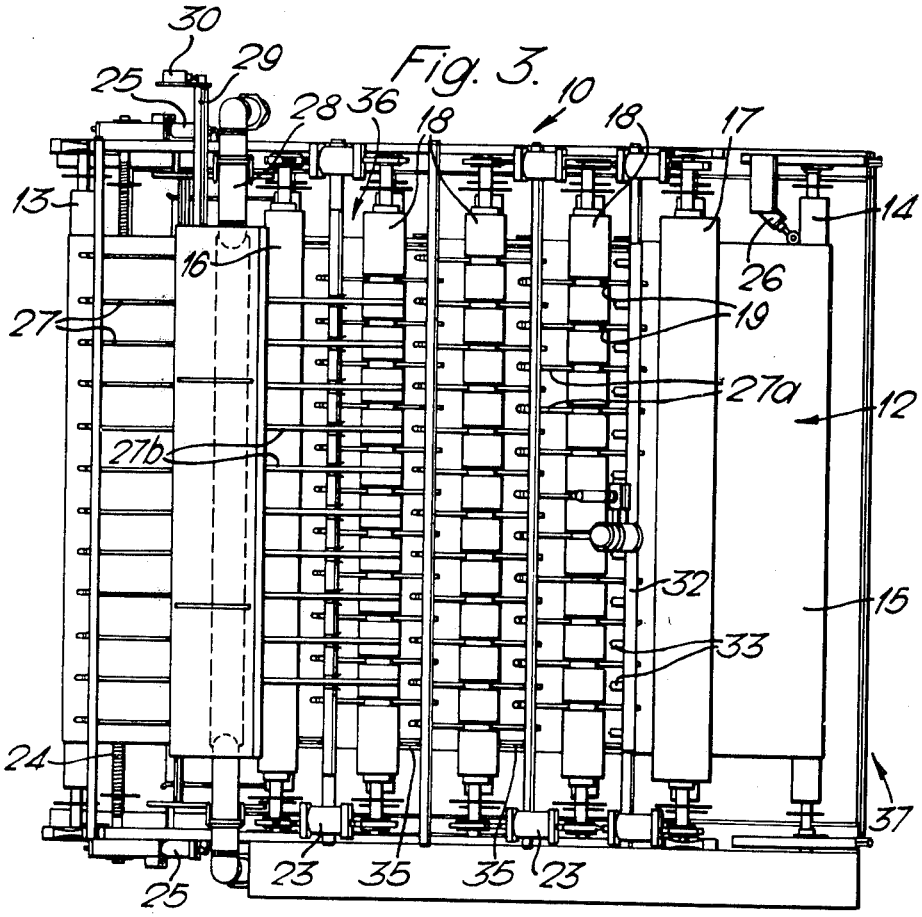
FIG. 3 is a plan view of the top frame.
Figure 2:
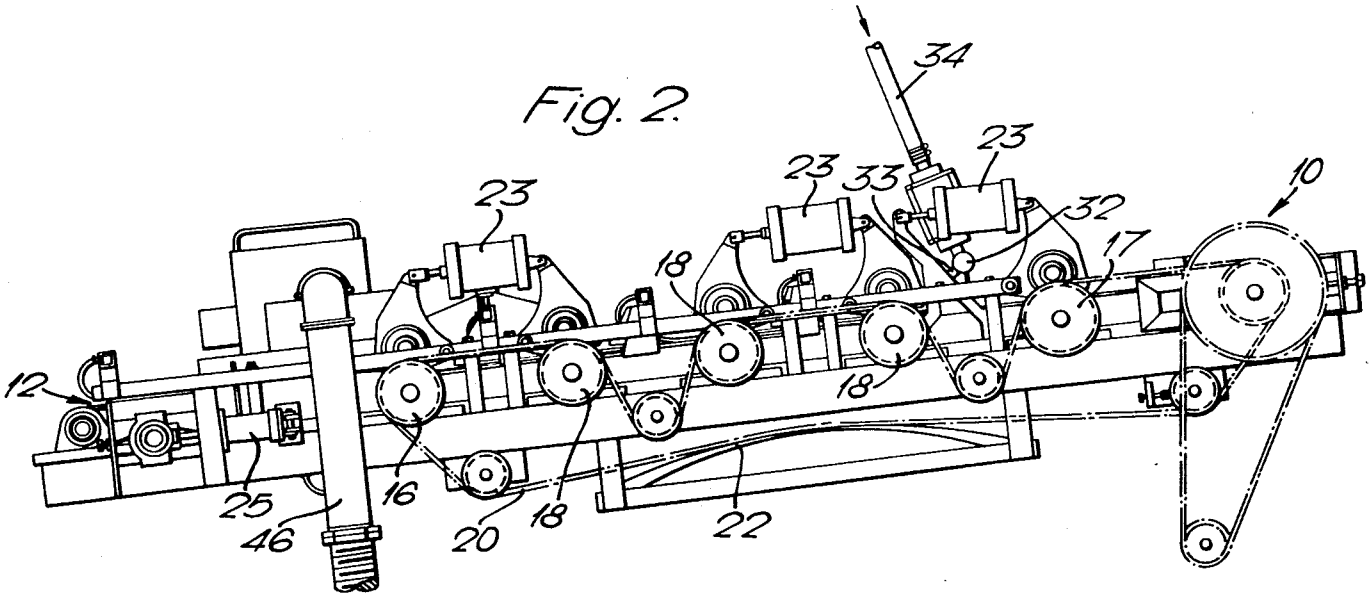
FIG. 2 is a side elevation of the top frame of the washing machine of FIG. 1, part of the casing being removed.
Figure 4:
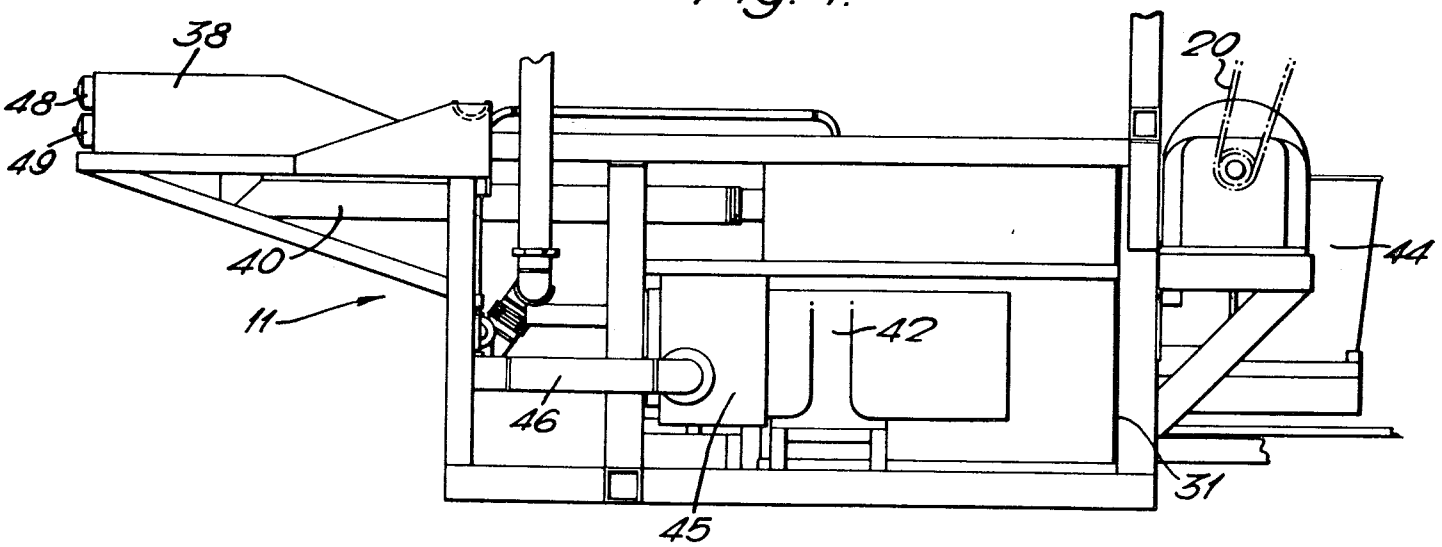
FIG. 4 is a side elevation of the bottom frame of the washing machine of FIG. 1.
Figure 5:
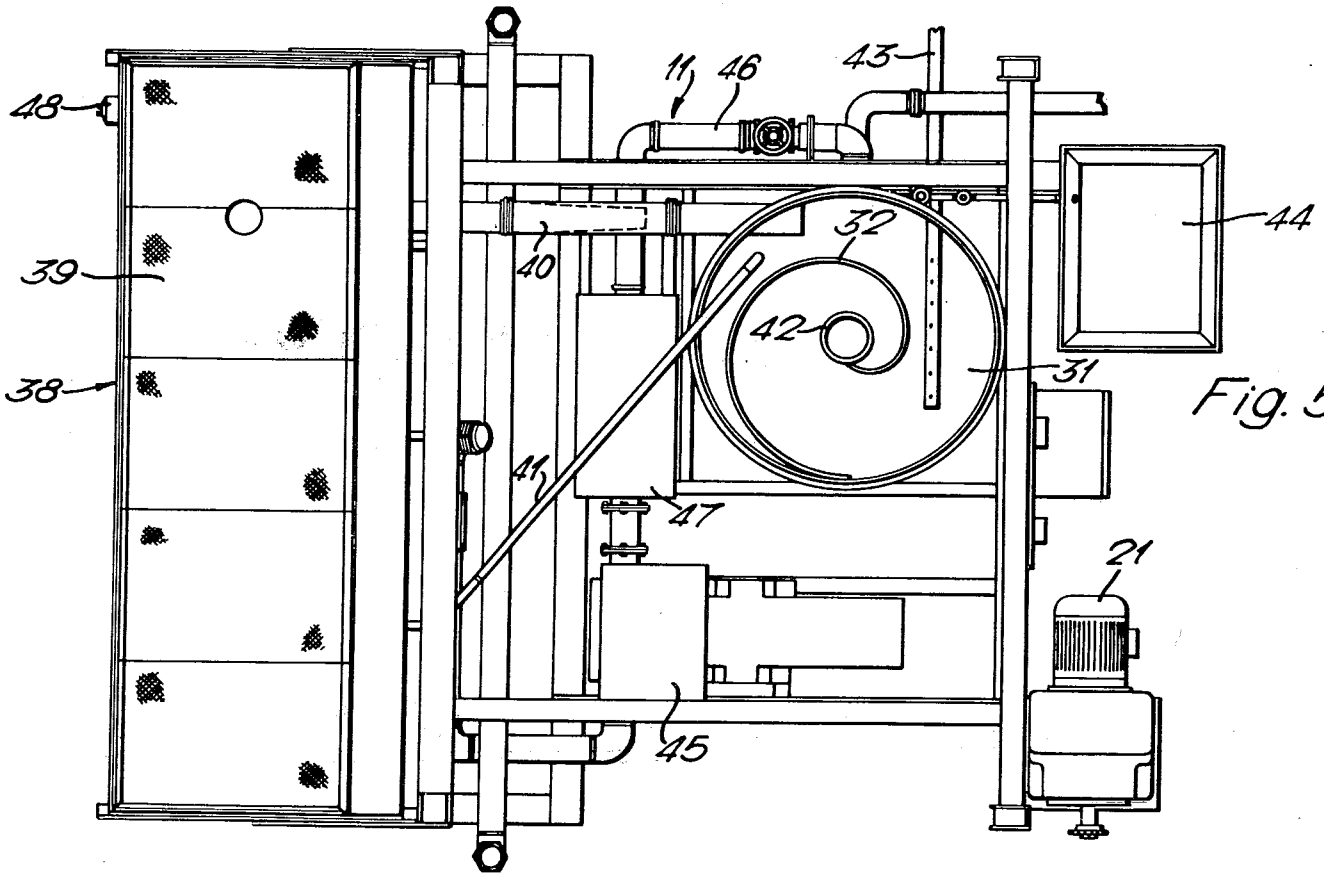
FIG. 5 is a plan view of the bottom frame.

The top frame, see FIGS. 2 and 3, comprises a continuous belt 12 formed of impervious material and extending between upstream and downstream rollers 13, 14 respectively, the plane of the upper section 15 of the belt being inclined upwardly in the downstream direction at an angle of about 15° to the horizontal.

The upper section 15 of the belt 12, in this embodiment, passes between four pairs of squeeze rollers followed by a pair of pressure rollers, each roller extending transversely of the belt 12 and adjacent pairs of rollers being spaced apart longitudinally of the belt. The first or extreme upstream squeeze rollers 16 and the larger diameter pressure rollers 17 are smooth surfaced rollers whilst the upper roller of each intermediate set of squeeze rollers 18 has a plurality of peripheral grooves 19 spaced apart along its length for the purpose described below. The bottom roller of each set of rollers 16, 17, 18 is driven by a chain drive 20 operated by an electric motor 21 (see FIG. 5). The chain drive 20 also drives the roller 13 and is provided with a chain tensioner 22. The upper roller of each set of rollers 16, 17, 18 applies pressure to the belt and a mat thereon by means of a pressure cylinder 23.

In this embodiment, especially because the belt 12 is short relative to its width, it is necessary to provide means to counteract any tendency for the belt to move laterally of its forward path. To meet this problem the bottom section of the belt 12 adjacent the lower, upstream end of the machine, is passed over a transverse roller 24 which has each end attached to the piston of a respective pneumatic ram 25 whereby the roller 24 may be inclined relative to the path of the belt and thereby cause the belt to move laterally in a desired direction. Adjacent the downstream end of the machine is a limit switch 26 which is capable of sensing a predetermined degree of lateral movement of the belt in either direction and thereupon actuate the ram 25 at the respective end of the roller 24 to cause the belt to move laterally in the other direction. In practice, the sensing means 26 and the rams 25 cause the belt to hunt within acceptable limits of lateral movement. To assist the degree of drive between the belt and the roller 24, the roller 24, in this embodiment, is provided with a roughened surface, e.g. a scrolled surface.

In order to wash a mat, the mat is fed right side up onto the upstream end of the belt 12 in a flat condition and is assisted to remain in a flat condition as it passes up the plane of the belt, by an arrangement of bars 27 extending longitudinally of the belt.

Disposed above the belt 12 and between the upstream roller 13 and the upstream squeeze rollers 16 is an outlet for washing liquid, the outlet in this embodiment being a pipe 28 having a plurality of jets or other openings in its underside and which extends across the belt. The size of the openings in the pipe 28 are designed to flood the mat with washing liquid as the mat passes underneath. To prevent the pressure of the washing liquid stopping the forward movement of the mat on the belt, the openings in the pipe are directed partially downstream to assist the forward movement of the mat. In addition, the washing liquid is not fed onto the mat until its leading edge contacts sensing means (not shown) by which time at least part of the mat is held on the belt by the bars 27. The sensing means act to pivot a transverse bar 29 and thereby actuate a micro-switch 30 which allows washing liquid to be discharged from the pipe 28 until the trailing edge of the mat allows the bar 29 to pivot back and thereby cause the switch 30 to stop the supply of washing liquid.

The mat then passes through the squeeze rollers 16 which remove a substantial part of the washing liquid which is collected with the remainder of the washing liquid and returned to a tank 31 as described below (FIGS. 4 and 5), and belts **27*b* are provided passing around the upper roller 16 and the adjacent upper roller 18 to prevent the mat from wrapping itself around the upper roller 16, i.e. to act as a stripper for the upper roller 16. For the same purpose bars 27*a* are provided for the upper roller of each pair of intermediate squeeze rollers 18**.

Between the rollers 17 and the last of the intermediate squeeze rollers 18 in the downstream direction is a second transverse pipe 32 having a series of discharge jets 33 directed partially upstream. This pipe 32 is connected to a supply pipe 34 for rinsing water. The rinsing water discharged from this pipe 32 is thereby capable of flowing onto the mat as the mat passes beneath the pipe and also of flowing through the upper roller of each set of transverse rollers 18 in turn by means of the above-mentioned peripheral grooves 19 which are arranged, in this embodiment, in the fashion of brickwork when viewed in plan (FIG. 3) to spread the rinsing water laterally across the mat. Alternatively the grooves 19 on each upper intermediate squeeze roller could be in the form of a scroll. Downstream of each upper intermediate roller and the upper roller of the rollers 16 the rinsing water collects as a pool which serves to soak the mat before it is squeezed by the next downstream set of rollers 18 or 17. The formation of these pools of rinsing water is assisted by the upward slope of the belt 12 which as mentioned above is impervious and by blocks 35 at the edges of the belt which at least resist lateral flow of the rinsing water off the belt immediately downstream of the rollers 16, 18, and urge the rinsing water to flow down the belt through the grooves 19. The rinsing water which runs off the edges of the belt, and this is allowed to occur especially between the first squeeze rollers 16 and the adjacent intermediate squeeze rollers 18, is allowed to pass into the tank 31.

By means of the above rinsing action, it will be appreciated that, in this embodiment, the mat is rinsed four times with progressively cleaner water all of which is supplied from a single source.

On leaving the pressure rollers 17, the cleaned mat passes from the belt 12 onto a conveyor 37 for drying and recoating with a dirt absorbent oil film.

If desired means may be provided for stripping the leading edge of the mat off the upper pressure roller 17 in like manner to the belts **27*b* and the bars 27*a* which act as strippers for each upper squeeze roller 16 and 18**.

The bottom frame 11 (see FIGS. 4 and 5) of the machine besides carrying the drive motor 21, carries a circulation system and the feed supply for the washing liquid. Instead of using a fresh supply of washing liquid for washing each mat, the washing liquid used for one mat is collected in the tank 31 together with the excess rinsing water and then the washing liquid for the next mat is withdrawn from this tank. The maximum amount of liquid is thus conserved for further use.

The used washing liquid is collected in a tray 38 covered with perforated filter plates 39 and fed through a conduit 40 into the tank 31. The used rinsing water is likewise collected in a tray 36 which extends beneath the belt and which comprises an extension of the tray 38, the rinsing water thereby passing through the conduit 40 into the tank. Within the tank 31 is a vertical baffle 32 which causes the washing liquid and the rinsing water to flow around the tank towards the centre of the tank from which a proportion of the liquid and the effluent from the washing and rinsing cycles passes out of the tank through an outlet pipe 42 which projects up into the centre of the tank and is connected to a drain. The remainder of the liquid remains in the tank 31 and is reheated by means of a steam pipe 43 which has a perforated end disposed within the tank. A thermostat (not shown) is also provided within the tank.

On actuation of the next washing cycle, a pump 45 withdraws the liquid required from the tank 31 through a conduit 46 provided with a filter box 47 and a connection (not shown) between the filter box and the pump for injecting a supply of soap from a reservoir 44 into the liquid. The conduit 46 is connected to both ends of the pipe 28 from which the washing liquid flows onto the mat to be washed.

Push button switches 48, 49 are provided for respectively starting the motor 21 for the drive to the belt 12 and the pump 45.

Several advantages are obtained by the washing machine described above over known machines suitable for washing dust mats.

Firstly, the washing action is a high pressure flushing action and not a scrubbing action and this is much more effective for washing the dust mat and in particular for removal of the oil film.

Secondly, the mat is retained in a flat condition throughout the washing and rinsing cycles.

Thirdly, because a proportion of the washing liquid is conserved for the next washing cycle, the overall amount of water used over a period of washing cycles is greatly reduced and also the amount of steam required to heat the water is reduced.

Fourthly, the peripheral grooves 19 of each upper roller 18 are disposed within the length of the respective roller which is important because of the length of rollers required for these particular dust mats.

In the embodiment described above, with the washing liquid flowing it is not possible to feed a mat up the belt unless the leading edge of the mat has passed the sensing means which pivot the bar 29 and thereby actuate the micro-switch 30. Similarly, it is not possible to feed the next mat up the belt until the washing liquid has stopped flowing down the belt for washing the previous mat and the inlet manifold has emptied. To reduce the time delay between the washing of successive mats, there may be provided a drop down baffle which is capable of directing the non-useful washing liquid discharged merely to empty the manifold laterally of the belt and thereby reducing the rate of flow of washing liquid down the belt. The baffle may be actuated, for example, simultaneously with the actuation of the switch 30 to stop the supply of washing liquid and may be raised by further sensing means actuated by the leading edge of the next mat to be washed prior to the leading edge contacting the sensing means which actuate the switch 30 to restart the supply of washing liquid.

It may be found desirable to provide a second set of smooth surfaced pressure rollers downstream of the rollers 17 should it be found that the rollers 17 are not sufficient on their own.

Similarly, there may be provided more or less than three sets of intermediate squeeze rollers 18.

Figure 6:
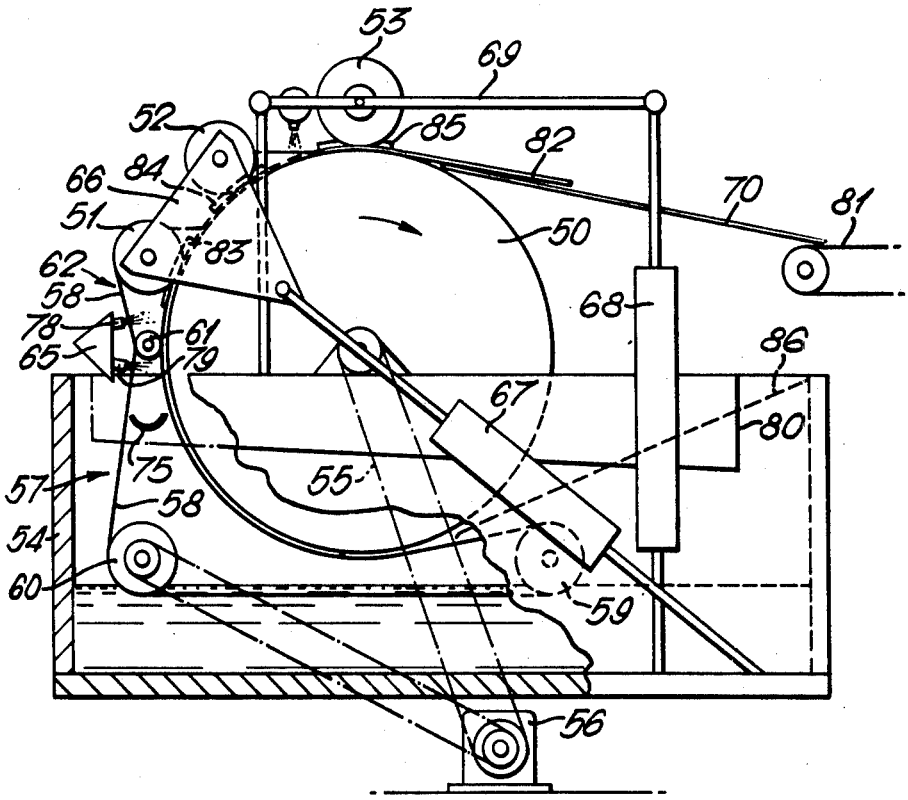
FIG. 6 is a diagrammatic elevation of another washing machine.
Figure 7:
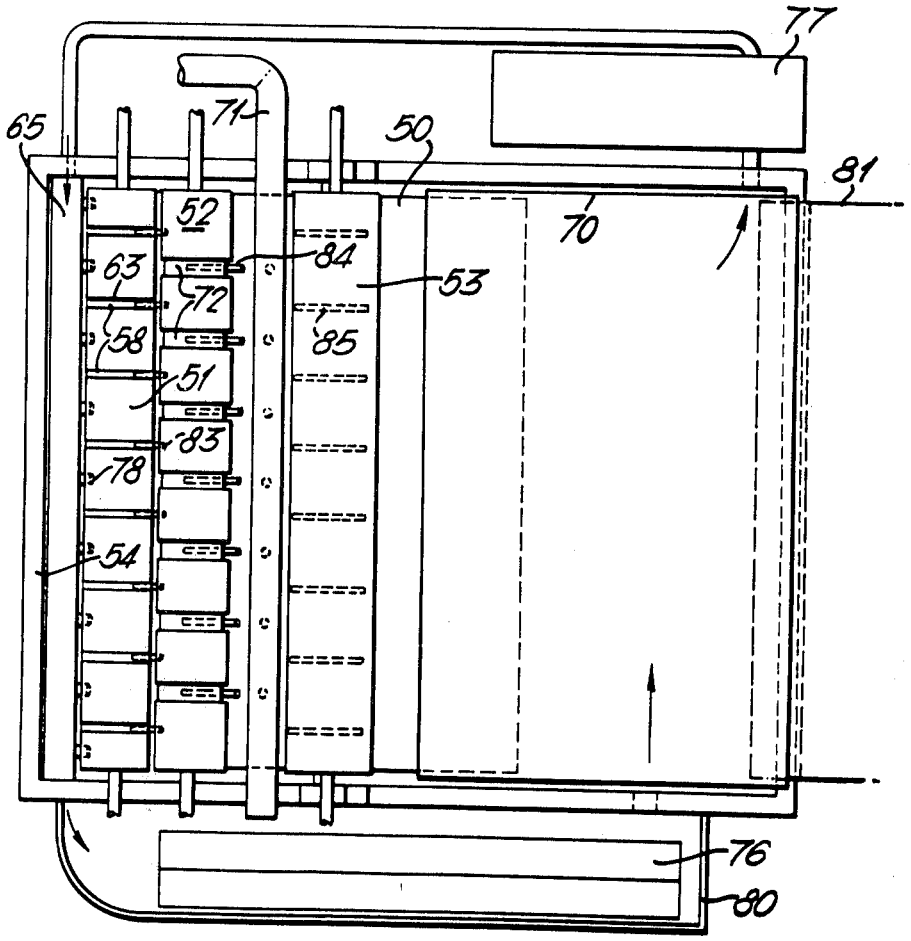
FIG. 7 is a diagrammatic plan view of the washing machine of FIG. 6.

Another embodiment of washing machine which effectively provides only one set of intermediate squeeze rollers 18 and thereby only two rinses of each mat, is shown in FIGS. 6 and 7.

The primary distinction between the specific embodiment described above and this other embodiment is that the feed belt 12 is replaced by a central drum 50 which has a large diameter relative to the squeeze rollers 51, 52 and the pressure roller 53, and thereby acts as the bottom roller for each of the rollers 51, 52 and 53.

As shown in FIGS. 6 and 7, the drum 50 is mounted above a tank 54 and has the rollers 51, 52 and 53 disposed thereabout at selected positions within the left-hand upper quartile of the drum 50 as viewed in FIG. 6 whereby control of the flow of rinsing water is facilitated. The drum 50 is fabricated of stainless steel or other suitable material and is driven in a clockwise direction as viewed in FIG. 1 by a belt drive 55 operable by an electric motor 56.

A chute 86, or otherwise a belt, is provided for feeding each mat in turn (or, each pair of mats in turn in the case of a machine sufficiently wide to handle two mats side by side) onto the underside of the drum 50, and a first moving carrier 57 is located beneath the drum 50 for holding the mat in surface contact with the drum until the mat reaches the washing station. A second shorter carrier 62 then takes over and holds the mat onto the drum until it has passed beneath the first squeeze roller 51. From then on, stationary stripping bars 83, 84, 85 are employed, as in the previous embodiment. Each carrier 57, 62 comprises a series of cords or belts 58, e.g. formed of material sold under the trade mark Polycord, which, in the case of the first carrier 57, pass around a series of three grooved spindles 59 to 61 of which the spindle 60 is driven by the electric motor 56. In the case of the second shorter carrier 62, the cords 58 pass around the spindle 61 and the first squeeze roller 51.

The cords 58 are spaced apart along the length of the spindles and the squeeze roller 51 (see FIG. 7), to allow washing liquid to be applied to the mat between the cords. Moreover, the grooves 63 in the roller 51 which receive the respective cords 58 have a cross-section corresponding to the cross-section of the cords. This is important because, for example, grooves having a larger dimension would allow at least some liquid to flow therethrough and it is particularly desirable to prevent upward flow of washing liquid which would contaminate the rinsing liquid.

In this embodiment the washing liquid is pumped from the tank 54 through a filter 77 to a manifold 65 from which it is sprayed at high pressure, e.g. at a rate of 200 gallons/minute at 100 lb/sq.in, onto the mat being washed through two rows of jets 78, 79 the lower row of jets 78 directing the washing liquid onto the mat upstream of the spindle 61 and between the cords of the first carrier 57, and the upper row of jets 79 directing the washing liquid onto the mat downstream of the spindle 61 and between the cords of the second carrier 62. It is thus ensured that the mat is sprayed with washing liquid across its full width.

Beneath the manifold 65 supplying the washing liquid there is positioned a catchment tray 75 for collection of the washing liquid and for returning it to the tank via an inclined filter 76 located in a housing 80 disposed on the opposite side of the tank from which the washing liquid is pumped for supplying the manifold 65.

Each end of the squeeze rollers 51, 52 is connected to a plate 66 which is urged radially of the drum 50 by a pneumatic or hydraulic cylinder 67 thereby urging the rollers 51, 52 towards the drum to effect the desired squeezing action on the mat passing therebetween. Rotation of the drum 50 will also feed the mat forwardly and drive each of the squeeze rollers 51, 52. Similarly, each end of the pressure roller 53 is urged against the drum 50 by a pneumatic or hydraulic cylinder 68 and a linkage 69 which serves to give a mechanical advantage to the pressure applied by the roller 53. The drum 50 also effects rotation of the roller 53 and serves to drive the mat forwardly beneath the pressure roller. A discharge chute 70 and a belt conveyor 81 are provided to carry the cleaned mats 82 from the washing machine.

The rinsing water is applied to the mats from a pipe 71 at low pressure, e.g. at a rate of 6 gallons/minute at 20 lb/sq. in., located between the squeeze roller 52 and the pressure roller 53. The squeeze roller 52 has circumferential grooves 72 along its length to allow the passage of rinsing water to flow in the opposite direction to the mat into the space between the squeeze rollers 51, 52. The mat is thus rinsed twice in water from a single supply, once between the squeeze rollers 51, 52 and a second time between the squeeze roller 52 and the pressure roller 53. Thus as in the previously described embodiment, the mat travels against the flow of the rinsing water so that the second rinse is performed in cleaner water than the first rinse. The pressure roller 53 which is of larger diameter than the preceding squeeze roller 52 acts as a mangle on the cleaned mat 82 before it is fed onto the discharge chute 70.

If desired, two or more intermediate squeeze rollers may be provided. Similarly a second pressure or mangle roller may be provided downstream (in the direction of travel of the mat) of the roller 53 and further around the circumference of the central drum 50.

Furthermore, there may be provided a brush, beater or vacuum upstream of the manifold 65 for applying the washing medium to the mat.

As compared with the washing machine of the previous embodiment the use of the central drum instead of the belt has several further advantages:

(1) The means for controlling lateral movement of the belt and hence the mats are not required.

(2) The control drum is more suitable for smaller, cheaper machines for which a lesser speed of output is acceptable. Such smaller machines have the advantage of a considerably smaller framework and floor space requirements. It may also be possible to use a smaller supply tank and water pump etc.

(3) The mat is returned on the same side of the machine as it is fed into the machine. If desired, means may be provided for rolling up the cleaned mats after their final mangle, and either before or after a drying step.

The washing machine may be used for other articles besides dust mats.

It will be appreciated that in each embodiment the rinsing part of the machine may be used independently of the washing part. There is thereby provided a rinsing machine for dust mats or other articles which may be used on its own or in combination with another machine which merely applies a washing liquid to an article to be washed.

We claim:

1. A rinsing machine suitable for rinsing a washable dust mat comprising in succession first squeeze means, pressure means following the first squeeze means and at least one intermediate squeeze means between the first squeeze means and the pressure means, each successive squeeze means and pressure means extending transversely of the direction of movement of the mat and being spaced apart from each other longitudinally of the direction of movement of the mat, means for applying rinsing water onto the mat between the pressure means and the intermediate squeeze means, and central guide means of arcuate shape for feeding the mat along an arcuate path through the first squeeze means, intermediate squeeze means and pressure means in succession, there being provided means entirely within the transverse extent of said squeeze means for allowing part of the rinsing water to pass from the intermediate squeeze means successively in the direction contrary to the direction of movement of the mat whereby the mat is rinsed within each squeeze means by water of which a part is removed by the next succeeding squeeze means and finally the pressure means, which means for allowing part of the rinsing water to pass from the intermediate squeeze means in a direction contrary to the direction of movement of the mat is disposed at least partially within the width of said central guide means.

2. A rinsing machine as claimed in claim 1 wherein each of the first squeeze means, the intermediate squeeze means and the pressure means is a roller cooperating with said central guide means to squeeze each mat in turn passed therebetween.

3. A rinsing machine as claimed in claim 2 wherein said central guide means is a drum around at least a part of whose circumference the mat is passed during the rinsing operation, means being provided to drive the drum.

4. A rinsing machine as claimed in claim 2, wherein the means for allowing part of the rinsing water to pass from the intermediate squeeze roller in a direction contrary to the direction of movement of the mat comprises parallel annular peripheral grooves in the roller.

5. A rinsing machine as claimed in claim 4, wherein there are said grooves in two adjacent rollers, the grooves of each roller being displaced longitudinally of the roller relatively to the grooves of the other roller.

6. A rinsing machine as claimed in claim 1 wherein means are provided for urging the mat to retain it against said central guide means as it passes towards the next succeeding squeeze means and subsequently towards the pressure means.

7. A washing machine suitable for washing a washable dust mat comprising a rinsing machine as claimed in claim 1, in combination with discharge means preceding the first squeeze means for flushing a mat with a washing liquid part of which is removed from the mat by the first squeeze means.

8. A washing machine as claimed in claim 7, wherein the rinsing water removed from the mat by the intermediate squeeze means and the pressure means is collected in a tank from which is supplied the liquid for washing the next mat.

9. A washing machine as claimed in claim 8, wherein the washing liquid is collected after use and returned into the same tank from which it has been drawn, a proportion of the liquid and the effluent being allowed to pass out of the tank into a drain, the remainder of the washing liquid mixing with the collected rinsing water in the tank and comprising the supply for washing the next mat.

* * * * *